US011443724B2

(12) United States Patent
Yeh

(10) Patent No.: US 11,443,724 B2
(45) Date of Patent: Sep. 13, 2022

(54) METHOD OF SYNCHRONIZING ELECTRONIC INTERACTIVE DEVICE

(71) Applicant: Tien-Der Yeh, Hsinchu (TW)

(72) Inventor: Tien-Der Yeh, Hsinchu (TW)

(73) Assignee: Mediawave Intelligent Communication, Hsinchu (TW)

( * ) Notice: Subject to any disclaimer, the term of this patent is extended or adjusted under 35 U.S.C. 154(b) by 0 days.

(21) Appl. No.: 16/448,123

(22) Filed: Jun. 21, 2019

(65) Prior Publication Data

US 2021/0193095 A1 Jun. 24, 2021

Related U.S. Application Data

(60) Provisional application No. 62/712,234, filed on Jul. 31, 2018.

(51) Int. Cl.

| | |
|---|---|
| ***G10H 1/08*** | (2006.01) |
| ***G10H 1/04*** | (2006.01) |
| ***G10H 1/00*** | (2006.01) |

(52) U.S. Cl.

CPC ..... *G10H 1/04* (2013.01); *G10H 1/0025* (2013.01); *G10H 1/08* (2013.01); *G10H 2240/041* (2013.01); *G10H 2240/325* (2013.01)

(58) Field of Classification Search

CPC ..... G10H 1/08; G10H 2210/076; G10H 2210/066; G10H 2250/235; G10H 2250/641; G10H 2210/081; G10H 2250/031; G10H 2210/061; G10H 2240/325; G10H 3/125

See application file for complete search history.

(56) References Cited

U.S. PATENT DOCUMENTS

| | | | | |
|---|---|---|---|---|
| 6,542,869 | B1 * | 4/2003 | Foote | G10H 1/00 704/500 |
| 8,069,036 | B2 * | 11/2011 | Pauws | G11B 27/034 704/205 |
| 2005/0177372 | A1 * | 8/2005 | Wang | G10H 1/00 704/273 |
| 2006/0000344 | A1 * | 1/2006 | Basu | G10H 1/0025 84/612 |
| 2012/0132057 | A1 * | 5/2012 | Kristensen | G09B 15/00 84/650 |
| 2012/0215546 | A1 * | 8/2012 | Biswas | G10H 1/40 704/500 |
| 2012/0294457 | A1 * | 11/2012 | Chapman | G10H 3/186 381/98 |
| 2016/0372096 | A1 * | 12/2016 | Lyske | G10H 1/368 |
| 2017/0097992 | A1 * | 4/2017 | Vouin | G10L 25/51 |
| 2017/0221463 | A1 * | 8/2017 | Lenhert | G10H 1/0025 |
| 2017/0371961 | A1 * | 12/2017 | Douglas | G06F 16/683 |
| 2021/0193095 | A1 * | 6/2021 | Yeh | G10H 1/0025 |

* cited by examiner

*Primary Examiner* — Marlon T Fletcher

(57) ABSTRACT

A method for synchronizing an electronic interactive device on basis of a first sound track is provided. The method may include identifying a first peak point and a valley point of the first sound track by calculating a first energy of the first peak point and a first energy of the valley point of the first peak point and comparing the first energy of the first peak point with first energy of neighboring points of the first peak point. The method may also include identifying a first peak point of a second soundtrack, and determining a similarity between the first soundtrack and a second sound track on basis of the first peak point of the first soundtrack and the first peak point of the second sound track.

18 Claims, 5 Drawing Sheets

METHOD OF SYNCHRONIZING ELECTRONIC INTERACTIVE DEVICE

CROSS-REFERENCE TO RELATED APPLICATION

This application claims the benefit of U.S. Provisional Application No. 62/712,234, filed on Jul. 31, 2018.

BACKGROUND

1. Technical Field

The present disclosure relates to an electronic interactive device, and, more particularly, to a method for synchronizing an electronic interactive device so that such electronic interactive device could be properly controlled at a predetermined point.

2. Description of Related Art

The electronic interactive device is usually configured to respond input signals in form of either a manual input or a machine-generated signal. For example, the properly controlled electronic interactive device, after receiving a music segment, could perform accordingly at certain predetermined points of the segment. For the electronic interactive device to be triggered at those points to perform prearranged actions, however, the electronic interactive device would have to recognize where it is in terms of timing of the music segment.

The electronic interactive device would store standard music segments and information of when it should respond. The electronic interactive device would receive a real time music segment. That the electronic interactive device could act on basis of the real time music segment largely hinges on if the electronic interactive device could associate the real time music segment with the standard music segment. Surrounding noises especially in music concert setting could just render more complicated associating the real time music segment with the standard one.

SUMMARY

The present disclosure provides a method for synchronizing an electronic interactive device on basis of the real time music segment.

With the disclosed method, the electronic interactive device may associate the real time music segment with the standard one, so as to be properly triggered at predetermined points of time of the standard music segment.

The disclosed method therefore may include identifying a first peak point and a valley point of a first sound track by calculating a first energy of the first peak point and a first energy of the valley point of the first peak point and comparing the first energy of the first peak point with first energy of neighboring points of the first peak point, and determining a similarity between the first soundtrack and the second sound track on basis of the first peak point of the first soundtrack and a first peak point of the second sound track.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of at least one embodiment corresponding with the reference figures.

Figure 1:
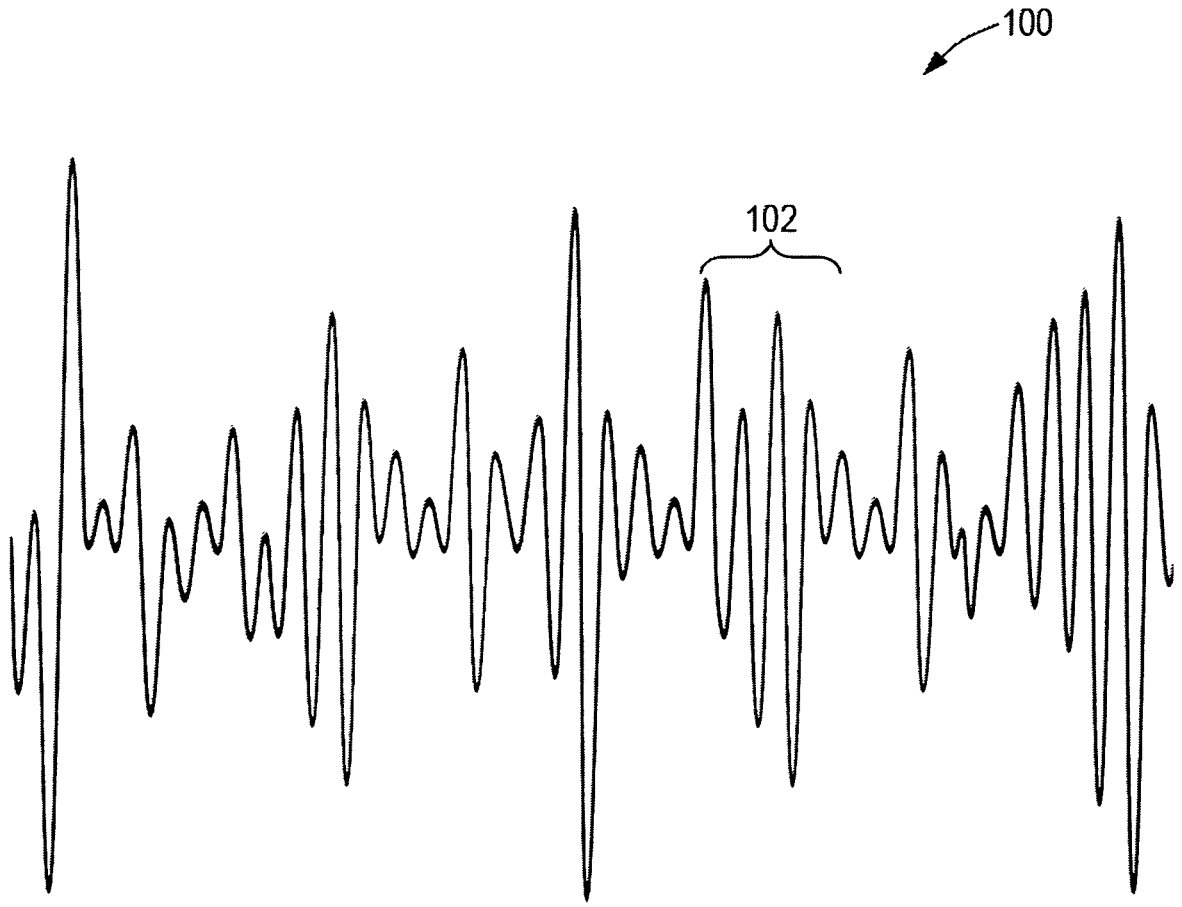
FIG. 1 shows a schematic diagram of a time domain waveform of a first soundtrack in terms of a pulse-code modulation (PCM) signal according to one embodiment of the present disclosure.

Please refer to FIG. 1 of a schematic diagram of a time domain waveform of a first soundtrack 100 in terms of a pulse-code modulation (PCM) signal according to one embodiment of the present disclosure. Amplitude of the first soundtrack 100 may be derived from one 16-bit PCM signal.

The first soundtrack 100 may include a sound segment 102 in a selected time frame. The sound segment 102 may define the smallest unit in the determination of similarity, which would be discussed later. The first soundtrack 100 may be considered as a standard soundtrack. Such standard soundtrack typically may be used to compare with, another soundtrack such as a second soundtrack (not shown). When the second soundtrack is similar enough to the first soundtrack, an electronic interactive device could function based on the second soundtrack as if performing according to the first soundtrack 100. The second soundtrack may be received by an electronic interactive device (not shown) in which the first soundtrack 100 may have been pre-installed therein. In another implementation, however, the first sound track may be stored external to the electronic interactive device.

For the determination of similarity between the first soundtrack 100 and the second soundtrack, the present disclosure may first identify peak points of the first soundtrack 100 and the second soundtrack. In other words, the electronic interactive device using the approach provided in the present disclosure may be configured to perform peak detection for both the first soundtrack 100 and the second soundtrack. In another implementation, the peak detection for the first soundtrack 100 may have been accomplished already while the electronic interactive device performs the peak detection for the second soundtrack. Such peak detection for the first soundtrack 100 may not necessarily be performed by the electronic interactive device.

The peak points identified in the peak detection may be employed by the electronic interactive device to find the similarity between the first soundtrack 100 and the second soundtrack so that the first soundtrack 100 and the second soundtrack could be synchronized if the second soundtrack is considered similar to the first soundtrack 100.

When the first soundtrack 100 and the second soundtrack are synchronized, the electronic interactive device despite operating with the second soundtrack may effectively perform the actions according to the first soundtrack.

The electronic interactive device in one embodiment could be a specialized one used in a concert and equipped with special sound effect. The electronic interactive device in another embodiment could be one mascot which could be triggered at predetermined points of the second soundtrack to perform certain acts. That the electronic interactive device is triggered at the predetermined points do not suggest the electronic interactive device would perform any action at those particular points. Rather, the electronic interactive device might wait for some time starting from points to trigger (or triggered points) before performing desired actions.

There might be two phases (e.g., training and matching) for the electronic interactive device to synchronize the first soundtrack 100 and the second soundtrack. During the training phase, the electronic interactive device may perform the peak detection for the first soundtrack 100. The electronic interactive device may perform the peak detection for the second sound track during the matching phase. It is worth noting that the peak detection for the first soundtrack 100 and the second soundtrack might be different.

Figure 2:
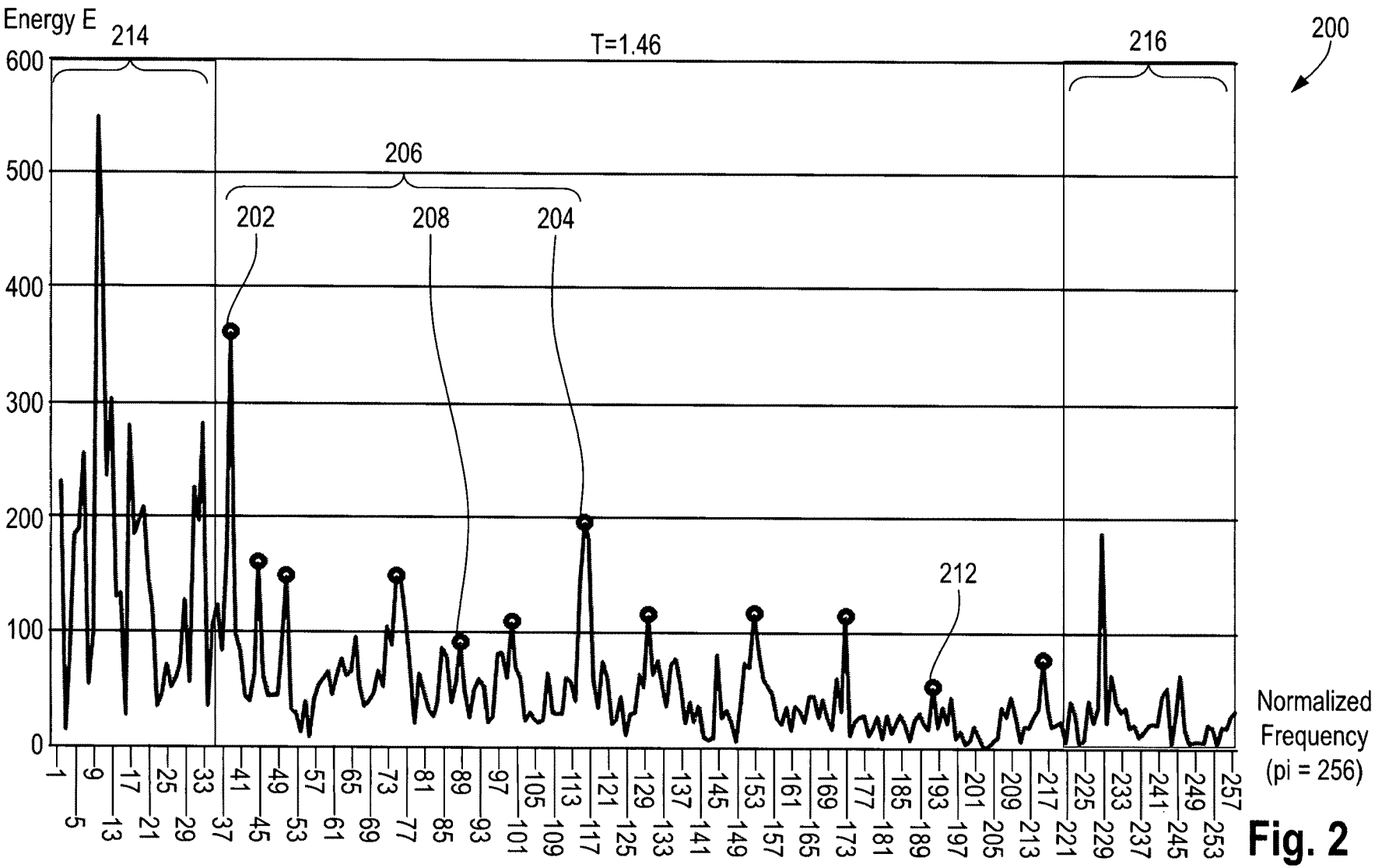
FIG. 2 shows peak points of one first soundtrack in terms of frequency domain after the performance of Fast Fourier Transform (FFT) on the first soundtrack according to one embodiment of the present disclosure.

FIG. 2 shows the peak points of one first soundtrack in terms of frequency domain after the performance of Fast Fourier Transform (FFT) on the first soundtrack according to one embodiment of the present disclosure. The first soundtrack 200 may be represented in terms of energy versus frequency, with the energy derived from the square root of the sum of squares of real part and imaginary part of the post-FFT first soundtrack.

The first soundtrack 200 may include multiple peak points such as a first peak point 202 and other peak points including the peak point 204. The first soundtrack 200 might just include one peak point (for example, the first peak point 202). The first peak point 202 or other peak points 204 may be identified within one time frame 206. In one embodiment, the length of one time frame is 32 mini seconds. However, the length of the time frame may vary depending on sample rates or the frequency domain characteristics of the first soundtrack.

Identifying the first peak point 202 or other peak points 204 may start from calculating energy of first peak point candidates before calculating energy of points in the neighborhood of the first peak point candidate. The points in the neighborhood of the first peak point candidate may be in the same time frame (such as the time frame 206). The energy of the first peak point candidate is supposed to be the largest among the points in the neighborhood of the first peak point candidate in energy, before such first peak point candidate may be considered as the first peak point. In one implementation, the number of the points in the neighborhood of the first peak point candidate is 16, with 8 on the right side of the first peak point candidate and the remaining 8 on the left side thereof.

The method according to the present disclosure may also identify valley points such as 208 and 212, whose energy might be less than the energy of the points in the neighborhood of the first peak point candidate. With the energy of the first peak point candidate and the energy of the valley points, one embodiment of the present disclosure may include calculating signal-to-noise ratio (SNR) on basis of the energy of the first peak point candidate and the valley points. The SNR of the first peak point candidate may be the result of the energy of the first peak point candidate divided by the energy of the valley points in the neighborhood of the first peak point candidate. The first peak point candidate associated with the SNR larger than a predetermined threshold may be the first peak point in the time frame.

When the first peak points with the SNR larger than the predetermined threshold appear in consecutive time frames (for example 2 consecutive time frames), those first peak points may be labeled as second peak points such as 204. The first peak point candidates with the energy larger than the predetermined threshold may be considered as the first peak points in another implementation. And those first peak points when present in the consecutive time frames may be considered as the second peak points. In short, different criteria may be used in the determination/selection of the first peak points.

In other words, the second peak points may be the sub-set of the first peak points. In another implementation, the second peak points may be equal to the first peak points in number. The second peak points may define a landmark of the first soundtrack. The landmark may be representative of characteristics of the first soundtrack. The first soundtrack may include multiple landmarks. The second peak points may serve as the basis for the similarity determination between the first soundtrack and the second soundtrack.

The first peak points of the second soundtrack may be with energy larger than their corresponding valley points and neighboring points. The present disclosure may not require the identification of the first peak points of the second soundtrack to determine whether those first peak points are present in the consecutive time frames or whether SNRs of those first peak points are larger than another predetermined ratio. In other words, compared with the identification of the first peak points of the first soundtrack the peak detection of the first peak points of the second soundtrack may be of more relaxed requirement. It is worth noting that more first peak points in the second soundtrack than the second peak points defining the first landmark in the first soundtrack may be identified.

The first peak point candidates, the first peak points, and the second peak points throughout the present disclosure may be sampling points of the first soundtrack in FFT form.

It is worth noting that as shown in FIG. 2 certain points may be simply ignored when it comes to the determination of the first peak points of the first soundtrack and the second soundtrack. Specifically, the points corresponding to frequencies cannot be picked up by ears of human beings may be ignored in the peak detection. Those points may be present in areas such as 214 and 216.

According to the present disclosure, certain points of high frequencies may serve as a watermark for the second soundtrack. Those high-frequency points may be added to the second soundtrack and when those points are presented the second soundtrack with those points may be considered "authentic." Identification of the first peak points for the second soundtrack may follow after the second soundtrack is considered "authentic." The watermark in one implementation is a predetermined formatted signal added to the second soundtrack. And that predetermined formatted signal is an ultrasound signal in one implementation.

At the time of determining the similarity between the first soundtrack and the second soundtrack, the present disclosure may determine the similarity between one landmark defined by the second peak points in the time frame of the first soundtrack (e.g., first landmark) and the first peak points of the second sound track.

The present disclosure might determine whether the first peak points of the second soundtrack are present in the second peak points of the first soundtrack, before concluding the first soundtrack and the second soundtrack are similar.

More specifically, the first peak points of the second soundtrack might be assigned with corresponding scores for the similarity determination.

For example, the score of the first peak point of the second soundtrack may be based on whether the same first peak point could be found among the second peak points of the first landmark. And even the same first peak points are found among the second peak points of the first soundtrack each of the second peak points may be assigned with a different weight. In this implementation, since the first second peak point might be more important than the third second peak point the first peak point in the second soundtrack corresponding to the first second peak point might be with a higher score than the first peak point in the second soundtrack corresponding to the third second peak point.

When the first peak points in the second soundtrack with the scores higher than the predetermined threshold, those first peak points might be used to match the second peak points in the first landmark of the first soundtrack. That those first peak points could match the second peak points in the first landmark may be indicative of high similarity between the first landmark of the first soundtrack and the first peak points of the second soundtrack.

Each point to trigger the electronic interactive device may correspond to multiple landmarks. In one implementation, the point to trigger the electronic interactive device may follow those landmarks.

When the first landmark of the first soundtrack and the first peak points of the second soundtrack are similar, the electronic interactive device may be triggered on basis of the second soundtrack (at least on basis of the segment of the second soundtrack having those first peak points in the same time frame with the first landmark of the first soundtrack). Since this particular segment of the second soundtrack is similar to the first landmark of the first soundtrack, the electronic interactive device may be triggered at the desired points as they correspond to the same points of time (in time domain) of the first soundtrack having the first landmark.

Figure 3:
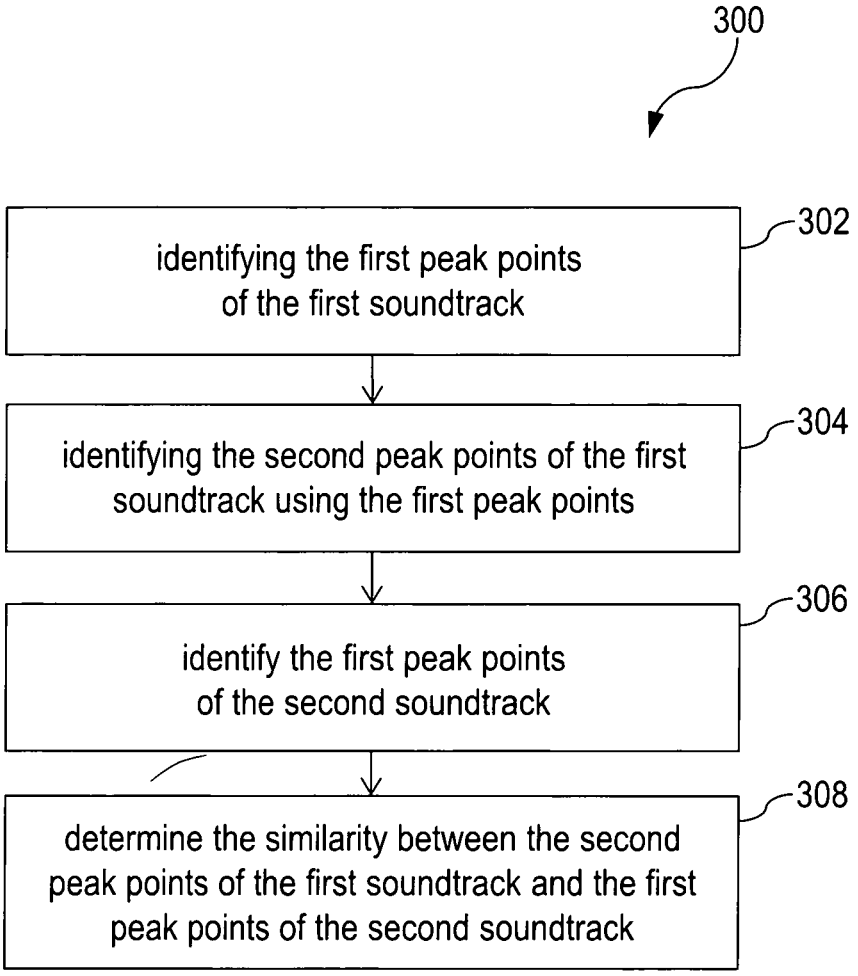
FIG. 3 shows a flow chart of a method of synchronizing a first soundtrack and a second soundtrack according to one embodiment of the present disclosure.

FIG. 3 is a simplified block diagram showing a method 300 of synchronizing the electronic interactive device with the second soundtrack using the first soundtrack according to one embodiment of the present disclosure.

The disclosed example method 300 may include identifying the first peak points of the first soundtrack (step 302). As previously mentioned, identifying the first peak points might include identifying the first peak point candidates in the same time frame before proceeding to promote the first peak point candidate to the first peak point (if any).

Identifying the first peak point candidates might include calculating the energy of the first peak point candidates and the energy of the points in the neighborhood of the first peak point candidate with the energy of the valley points in the same neighborhood. Once after the first peak point candidates are identified, the method according to the present disclosure might include promoting the first peak point candidate to the first peak points.

The method 300 may also include on basis of the certain predetermined thresholds identifying the second peak points of the first soundtrack using the first peak points (step 304). The thresholds, for example, could be in terms of energy level of the first peak points, the SNR of those first peak points, and/or number of appearances of the first peak points in the consecutive time frames.

In step 306, the method 300 may identify the first peak points of the second soundtrack. The criteria of identifying the first peak points of the second soundtrack might be different from that of identifying the first peak points of the first soundtrack.

In step 308, the method 300 may determine the similarity between the second peak points of the first soundtrack and the first peak points of the second soundtrack.

When the first soundtrack and the second soundtrack are similar, the points to trigger in the time domain of the first soundtrack and the second soundtrack might align with each other. Therefore, the points to trigger in the time domain of the first soundtrack at which the electronic interactive device might respond or perform the designated actions might become the same points in the time domain of the second soundtrack, allowing for the electronic interactive device to successfully synchronize the first soundtrack and the second soundtrack and to be triggered according to the first soundtrack as desired.

The method 300 might also include identifying if there is any presence of the watermark in the second soundtrack, before performing the peak detection for both the first soundtrack and the second soundtrack and determining the similarity between the first soundtrack and the second soundtrack.

Figure 4:
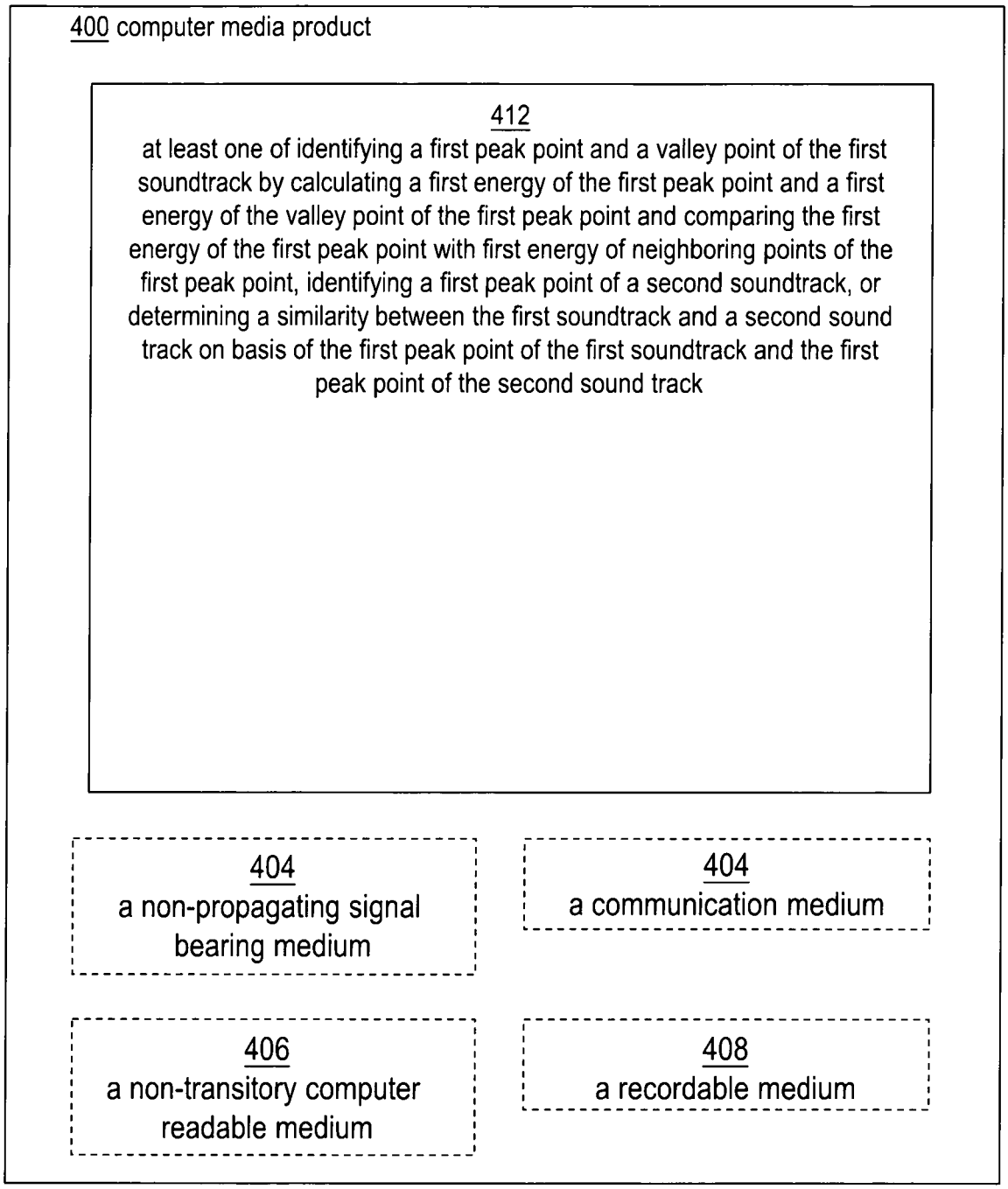
FIG. 4 shows a schematic diagram illustrating a non-transitory computer readable media product according to one embodiment of the present disclosure.

FIG. 4 is a schematic diagram illustrating a non-transitory computer readable media product 400, according to one embodiment of the present disclosure. The non-transitory computer readable media product 400 may comprise all computer-readable media, with the sole exception being a transitory, propagating signal. For example, the computer readable media product 400 may include a non-propagating signal bearing medium 402, a communication medium 404, a non-transitory computer readable medium 406, and a recordable medium 408. The computer readable media product 400 may also include computer instructions 412 when executed by the processing unit causing the processing unit to perform the method for synchronizing the interactive electronic device on basis of the first soundtrack.

Figure 5:
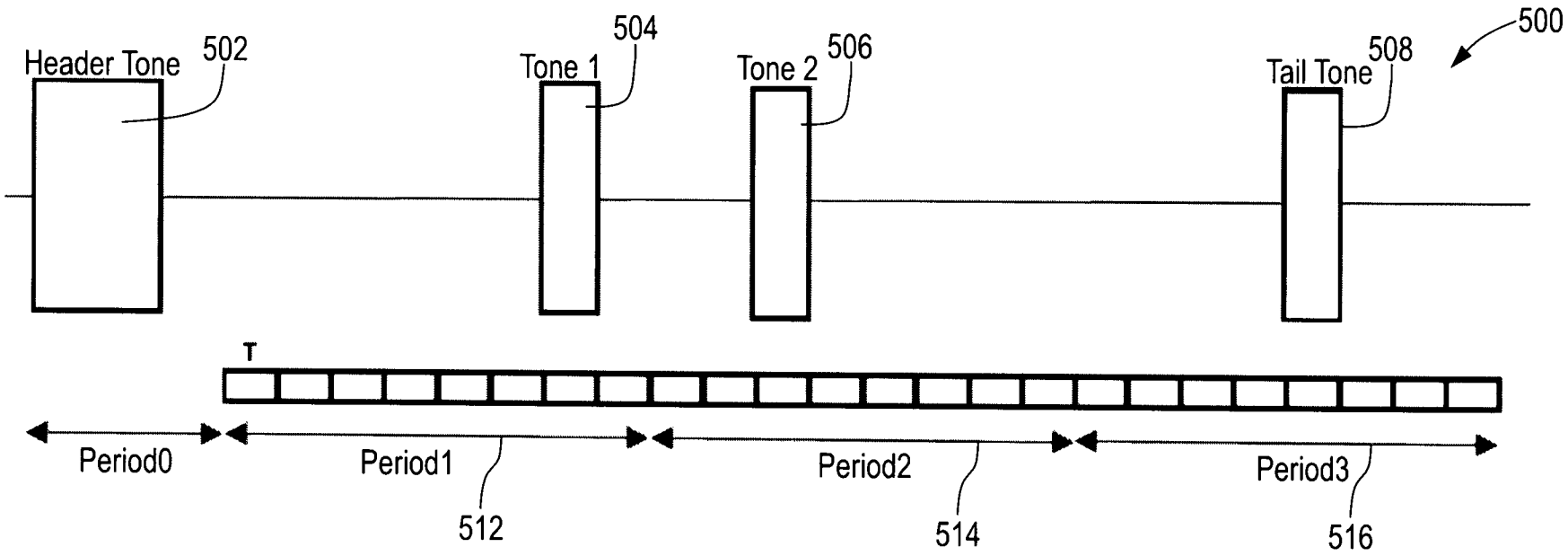
FIG. 5 shows a watermark used according to one embodiment of the present disclosure.

FIG. 5 shows a sound packet 500 with a watermark according to one embodiment of the present disclosure. The packet 500 with the watermark may include multiple tone segments 502-508.

Each of the tones may be a burst of sound energy of a single sinusoidal frequency. The sinusoidal frequency in one implementation may be selected around 18 KHz. More specifically, a header tone 502 may be at 18.05 KHz at a length of 2 T (T refers to a time slot). Other tones such as tone 1 504, tone 2 506, and tail tone 508 might be sinusoidal waves of frequencies less or larger than 18.5 KHz with a length of T. In one implementation, T may be equal to 100 mini seconds (ms). For example, the tone 1 504 might be 17.9 KHz, which is 0.15 KHz less than the frequency of the header tone 502. The tone 2 506 might be 18.20 KHz, which is 0.15 KHz more than the frequency of the header tone 502. The tail tone might be 18.35 KHz, which is 0.15 KHz more than the frequency of the tone 2 506. It is worth noting that the tail tone might indicate the end of a packet to be transmitted.

Outside of the header tone 502, the tone 1 502, the tone 2 504, and the tail tone 506 might be in different periods 512-516 as illustrated in FIG. 5. The period 512, 514, or 516 in one implementation might be 8 T in length and the tone 1 502, the tone 2 504, and the tail tone 506 might be at different locations of the 8 T-long period, which might create different spacing from each other.

The number of the tones might depend on the size of the information to be transmitted in the packet. For example, data bits 0-5 might be carried by the tone 1 502, data bits 6-11 might be carried by the tone 2 504, and data bits 12-13 and error checking bits C0-C3 (which might suggest checksum CRC4 for error detection is used) might be carried by the tail tone 506.

In another implementation, the time slots other than that occupied by the header tone 502 might not be associated with any sinusoidal frequency. Consequently, however, this implementation might be with a reduced SNR (compared with the previous example), especially when noises are taken into account. The example of the header tones along with other tomes in connection with certain sinusoidal frequencies might increase the use of the bandwidth in transmission. The sound energy of the tones with the sinusoidal frequencies might increase as well.

Some modifications of these examples, as well as other possibility will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A method for synchronizing an electronic interactive device on basis of a first sound track in terms of a time domain signal, comprising:

identifying a first peak point and a valley point of the first soundtrack by calculating a first energy of the first peak point and a first energy of the valley point of the first peak point and comparing the first energy of the first peak point with first energy of neighboring points of the first peak point;

identifying a first peak point of a second soundtrack;

determining a signal-noise ratio (SNR) in connection with the first peak point to define a second peak point, wherein the number of the second peak points is no more than the number of the first peak points, and the second peak point is represented in terms of the frequency domain; and determining a similarity between the first soundtrack and the second sound track on basis of the first peak point of the first soundtrack and the first peak point of the second sound track;

wherein the first peak point, the valley point, the neighboring points of the first soundtrack, and the first peak point of the second soundtrack are represented in terms of a frequency domain.

2. The method according to claim 1, further comprising determining whether the first energy of the first peak point of the first soundtrack is larger than the first energy of the neighboring points of the first peak point, before identifying the first peak point of the first soundtrack.

3. The method according to claim 1, further comprising identifying the valley point with the first energy thereof lower than the first energy of the neighboring points.

4. The method according to claim 1, further comprising determining presence of the first peak points in consecutive time frames before defining a first landmark of the first sound track using the first peak points.

5. The method according to claim 1, wherein determining the SNR in connection with the first peak point further comprises dividing the first energy of the first peak point by the first energy of the valley point.

6. The method according to claim 4, further comprising associating the first landmark with the multiple second peak points of the first sound track and determining the similarity between the first soundtrack and the second soundtrack on basis of whether the first peak point of the second soundtrack matches any of the second peak points of the first soundtrack.

7. The method according to claim 6, further comprising determining the similarity between the first soundtrack and the second soundtrack on basis of difference in number between the second peak points of the first landmark and the first peak points of the second soundtrack, wherein the second peak points of the first landmark are of a same weight or different weights.

8. The method according to claim 7, further comprising associating the second soundtrack with the first soundtrack in a time domain for the electronic interactive device to perform a predetermined action according to the first soundtrack, when the first soundtrack and the second soundtrack are considered similar.

9. The method according to claim 1, further comprising recognizing a watermark in terms addition of a predetermined formatted signal to the second soundtrack.

10. A non-transitory computer readable medium comprising a set of computer instructions capable of synchronizing an electronic interactive device on basis of a first soundtrack in terms of a time domain signal when executed by a processing unit of the electronic interactive device causing the processing unit of the electronic interactive device to:

identify a first peak point and a valley point of the first sound track by calculating a first energy of the first peak point and a first energy of the valley point of the first peak point and compare the first energy of the first peak point with first energy of neighboring points of the first peak point;

identify a first peak point of a second soundtrack;

determine a signal-noise ratio (SNR) in connection with the first peak point to define a second peak point, wherein the number of the second peak points is no more than the number of the first peak points, and the second peak point is represented in terms of the frequency domain; and determine a similarity between the first soundtrack and the second sound track on basis of the first peak point of the first soundtrack and the first peak point of the second sound track;

wherein the first peak point, the valley point, the neighboring points of the first soundtrack, and the first peak point of the second soundtrack are represented in terms of a frequency domain.

11. The non-transitory computer readable medium according to claim 10, further comprising the computer instructions when executed by the processing unit of the electronic interactive device causing the processing unit of the electronic interactive device to determine whether the first energy of the first peak point of the first soundtrack is larger than the first energy of the neighboring points of the first peak point, before identifying the first peak point of the first soundtrack.

12. The non-transitory computer readable medium according to claim 10, further comprising the computer instructions when executed by the processing unit of the electronic interactive device causing the processing unit of the electronic interactive device to identify the valley point with the first energy thereof lower than the first energy of the neighboring points.

13. The non-transitory computer readable medium according to claim 10, further comprising the computer instructions when executed by the processing unit of the electronic interactive device causing the processing unit of the electronic interactive device to determine presence of the first peak points in consecutive time frames before defining a first landmark of the first sound track using the first peak points.

14. The non-transitory computer readable medium according to claim 10, further comprising the computer instructions when executed by the processing unit of the electronic interactive device causing the processing unit of the electronic interactive device to determine the SNR in connection with the first peak point by dividing the first energy of the first peak point by the first energy of the valley point.

15. The non-transitory computer readable medium according to claim 13, further comprising a set of computer instructions when executed by a processing unit of the electronic interactive device causing the processing unit of the electronic interactive device to associate the first landmark with the multiple second peak points of the first sound track and determine the similarity between the first soundtrack and the second soundtrack on basis of whether the first peak point of the second soundtrack matches any of the second peak points of the first soundtrack.

16. The non-transitory computer readable medium according to claim 15, further comprising the computer instructions when executed by the processing unit of the electronic interactive device causing the processing unit of the electronic interactive device to determine the similarity between the first soundtrack and the second soundtrack on basis of difference in number between the second peak points of the first landmark and the first peak points of the second soundtrack, wherein the second peak points of the first landmark are of a same weight or different weights.

17. The non-transitory computer readable medium according to claim 16, further comprising the computer instructions when executed by the processing unit of the electronic interactive device causing the processing unit of the electronic interactive device to associate the second soundtrack with the first soundtrack in a time domain for the electronic interactive device to perform a predetermined action according to the first soundtrack, when the first soundtrack and the second soundtrack are considered similar.

18. The non-transitory computer readable medium according to claim 10, further comprising the computer instructions when executed by the processing unit of the electronic interactive device causing the processing unit of the electronic interactive device to recognize a watermark in terms addition of a predetermined formatted signal to the second soundtrack.

* * * * *